US006050173A

United States Patent [19]

Sakai et al.

[11] Patent Number: 6,050,173

[45] Date of Patent: Apr. 18, 2000

[54] CAM MOTOR APPARATUS

[75] Inventors: Toshiyuki Sakai; Yoichiro Kotake; Toshihiro Naruse, all of Osaka; Masaaki Suhara, Oaaka, all of Japan

[73] Assignee: Daikin Industries, Ltd., Osaka, Japan

[21] Appl. No.: 09/091,839

[22] PCT Filed: Oct. 30, 1997

[86] PCT No.: PCT/JP97/03986

§ 371 Date: Jun. 25, 1998

§ 102(e) Date: Jun. 25, 1998

[87] PCT Pub. No.: WO98/20255

PCT Pub. Date: May 14, 1998

[30] Foreign Application Priority Data

Nov. 1, 1996 [JP] Japan ..... 8-291621

[51] Int. Cl.[7] ..... F01B 1/06; F03C 1/36

[52] U.S. Cl. ..... 91/491; 91/482

[58] Field of Search ..... 91/491, 498, 482

[56] References Cited

U.S. PATENT DOCUMENTS

| | | | |
|---|---|---|---|
| 4,532,854 | 8/1985 | Foster | 91/491 X |
| 4,724,742 | 2/1988 | Bigo et al. | 91/491 |
| 4,898,076 | 2/1990 | Bigo et al. | 91/491 |
| 5,220,790 | 6/1993 | Allart et al. | 60/435 |
| 5,435,135 | 7/1995 | Lallier et al. | 91/491 X |

FOREIGN PATENT DOCUMENTS

| | | |
|---|---|---|
| 50-7947 | 1/1975 | Japan . |
| 55-153871 | 12/1980 | Japan . |
| 62-168972 | 7/1987 | Japan . |
| 4-228878 | 8/1992 | Japan . |
| 1 399 596 | 7/1975 | United Kingdom . |
| 2 253 658 | 9/1992 | United Kingdom . |
| 2 278 890 | 2/1994 | United Kingdom . |

*Primary Examiner*—Timothy S. Thorpe
*Assistant Examiner*—David J. Torrente
*Attorney, Agent, or Firm*—Nixon Peabody LLP; Eric J. Robinson; Donald R. Studebaker

[57] ABSTRACT

A cam motor apparatus A is configured such that a cylinder block (2) rotating together with an output shaft (10) is internally provided with a plurality of cylinders (5, 5, . . . ) formed radially in a direction orthogonal to a rotational axis (X) of the cylinder block (2) and pistons (6) respectively housed in the cylinders are reciprocated by the action of working oil distributed thereto by a distribution valve (7) thereby rotating the output shaft. The cam motor apparatus A further includes a selector valve (9) for selectively communicating each of the cylinders with a supply passage (81) or a discharge passage (82) for working oil through the distribution valve. When the selector valve is in a low rotational speed position, working oil is supplied to and discharged from all the cylinders. On the other hand, when the selector valve is changed into a high rotational speed position, working oil is supplied to and discharged from a half of the cylinders and pressurized oil is supplied from a charging pump (16) to the remaining cylinders.

5 Claims, 6 Drawing Sheets

CAM MOTOR APPARATUS

TECHNICAL FIELD

This invention relates to a cam motor apparatus used as a motor for traveling a construction machine or a motor for other purposes, and specifically relates to a cam motor apparatus configured such that the motor capacity is changed between large and small stages so that the rotation is changed between a low-speed mode rotating at low speed and a high-speed mode rotating at a speed higher than that in the low-speed mode.

BACKGROUND ART

As a cam motor apparatus of such kind, there is known a conventional cam motor apparatus configured such that a plurality of pistons and cylinders are divided into four groups and the condition of distribution of working oil to the pistons and cylinders included in each group is changed between two stages through the operation of a selector valve (See, for example, FIG. 2 in Japanese Patent Application Laid-Open Gazette No. 55-153871). In this motor, when the selector valve is changed to a low-speed mode, working oil is supplied to each cylinder included in two groups selected from among the four groups, whereas each cylinder included in the other two groups is connected to an oil tank so as to discharge working oil thereto. Thereby, the motor capacity of the cam motor apparatus becomes a maximum value so that the motor is rotated at relatively low speed and high output torque.

On the other hand, when the selector valve is changed to a high-speed mode, working oil is supplied to each cylinder included in one of the selected two groups, working oil is discharged from each cylinder included in one of the other two groups, and cylinders included in the remaining two groups are connected to each other to form a closed circuit. Thereby, the motor capacity becomes half the value in the low-speed mode so that high-speed rotation is made at a speed approximately twice as fast as the low-speed mode.

In the conventional cam motor apparatus above-described, however, since each cylinder included in the two groups in which neither oil supply nor oil discharge is made in the high-speed mode has a closed circuit, no escape route is left for pressurized oil in the cylinder so that large resistance to the motor rotation may be produced. To cope with this, it can be considered that each cylinder included in the above-mentioned two groups is communicated with the oil tank. In this case, however, the oil pressure of each cylinder included in the two groups becomes close to the atmospheric pressure so that slide contact between the piston and the cam surface in the cylinder cannot be held by the oil pressure. As a result, undesirable beat sounds are produced due to collision between the piston and the cam surface, and the piston and the cam surface are decreased in durability.

To eliminate the above problems, it is necessary to dispose a spring between the piston and the bottom surface of the cylinder room as in the conventional cam motor apparatus so as to press the piston against the cam surface by the spring. In this case, however, the component count of the apparatus is increased. This increases the weight of the apparatus and complicates the structure thereby involving much expense in time and effort for assembly.

In view of the foregoing problems, the present invention has been made. Therefore, an object of the present invention is to hold slide contact between the piston and the cam surface thereby increasing silentness and durability and to decrease component count thereby reducing weight and increasing ease of assembly.

DISCLOSURE OF THE INVENTION

To attain the above object, in the present invention, pressurized oil is supplied from a charging pump, provided for supplying working oil to the working oil supply system of the cam motor apparatus so as to cope with leakage of the working oil, to the piston which falls into a state that no driving force is produced in a high-speed mode. As a result, slide contact between the piston and the cam surface can be held.

More specifically, as shown in FIGS. 1 and 2, the present invention premises a cam motor apparatus comprising: a cylindrical cylinder block (2); a cam ring (3) having a cam surface (3*a*) formed in the inner periphery thereof and disposed surrounding the outer periphery of the cylinder block (2); a plurality of cylinders (5, 5, . . . ) radially formed in the cylinder block (2) to extend radially outward around the central axis (X) of the cylinder block (2) and to be open in the outer periphery of the cylinder block (2); pistons (6) respectively housed in the cylinders (5) in a manner to extend to and retract from the cam surface (3*a*); and a distribution valve (7), coupled to an end surface (2*a*) of the cylinder block (2) in a manner to be rotatable relative to the cylinder block (2), for distributing working oil, supplied from a working oil supply system (150), to the cylinders (5) corresponding to the pistons (6) in an ascending cycle of ascending toward the cam surface (3*a*) out of the plurality of cylinders (5, 5, . . . ), wherein the pistons (6) in the ascending cycle press the cam surface (3*a*) so that one of the cylinder block (2) and the cam ring (3) the other of which is fixed in a non-rotating state rotates relative to the other.

The cam motor apparatus having the above structure further comprises: four communication passages (8*a*, 8*b*, 8*c*, 8*d*) for supplying working oil to the plurality of cylinders (5, 5, . . . ) divided into four groups in a manner to distribute the working oil among the four groups; and a selector valve (9) for selectively connecting the four communication passages (8*a*, 8*b*, 8*c*, 8*d*) to an oil supply side or an oil discharge side of the working oil supply system (150) to change the rotation of the cylinder block (2) or the cam ring (3) between a low-speed mode and a high-speed mode.

Further, the cylinder block (2) is provided with distributed-side ports (21, 21, . . . ) which are communicated with the respective cylinders (5, 5, . . . ) and are open at the end surface (2*a*) at uniform intervals on a circumference around the central axis (X). The distribution valve (7) is provided at an end surface (7*a*) coupled to the cylinder block (2) with distribution ports (71, . . . , 72, . . . , 73, . . . , 74, . . . ) a count of which is an integral multiple of 4 and which are formed to be open at uniform intervals on the same circumference as the distributed-side ports (21, 21, . . . ) are located, the distribution ports (71, . . . , 72, . . . , 73, . . . , 74, . . . ) being divided into four distribution port groups having the same port count, the distribution ports being each communicated at an end thereof with one of the four communication passages (8*a*, 8*b*, 8*c*, 8*d*) in units of the distribution port groups.

The selector valve (9) includes: a low rotational speed position that connects two passages (8*c*, 8*d* or 8*a*, 8*b*), selected from among the four communication passages (8*a*, 8*b*, 8*c*, 8*d*), to the oil supply side of the working oil supply system (150) and connects the other two passages (8*a*, 8*b*, or 8*c*, 8*d*) to the oil discharge side of the working oil supply system (150); and a high rotational speed position that connects one (8*c* or 8*a*) of the selected two passages to the oil supply side, connects one (8*a* or 8*c*) of the other two passages to the oil discharge side and connects the remaining two passages (8*d*, 8*b*) to a delivery side of a charging pump (16) for supplying charging oil to the oil discharge side of the working oil supply system (150).

Under the above configuration, when the selector valve (9) is in the low rotational speed position, two passages (8*c*, 8*d*or 8*a*, 8*b*) selected from among the four passages are connected to the oil supply side of the working oil supply system (150) and the other two passages (8*a*, 8*b* or 8*c*, 8*d*) are connected to the oil discharge side of the working oil supply system (150). Thereby, working oil is supplied from the selected two passages (8*c*, 8*d*or 8*a*, 8*b*) to the cylinders (5) in which the pistons (6) are in the ascending cycle of ascending toward the cam surface (3*a*) through the distribution ports (71, . . . , 73, . . . or 72, . . . , 74, . . . ) and the distributed-side ports (21, 21, . . . ). The pistons (6) housed in the cylinders (5) press the cam surface (3*a*) so that one of the cylinder block (2) and the cam ring (3) rotates relative to the other. Working oil is discharged from the cylinders (5) in which the pistons (6) are in a descending cycle of descending toward the rotational axis (X), passes through the distributed-side ports (21, 21, . . . ) and the distribution ports (72, . . . , 74, . . . or 71, . . . , 73, . . . ) and is returned to the oil discharge side of the working oil supply system (150) through the non-selected two passages (8*c*, 8*b* or 8*c*, 8*d*). As a result, the cam motor apparatus obtains a maximum motor capacity to rotate in the low-speed mode where the speed is relatively low and the output torque is relatively high.

On the other hand , when the selector valve (9) is in the high rotational speed position, one (8*c* or 8*a*) of the selected two passages (8*c*, 8*d*or 8*a*, 8*b*) is connected to the oil supply side of the working oil supply system (150), one (8*a* or 8*c*) of the other two passages (8*a*, 8*b* or 8*c*, 8*d*) is connected to the oil discharge side of the working oil supply system (150), and the remaining two passages (8*d*, 8*b*) are connected to the delivery side of the charging pump (16) for supplying charging oil to the oil discharge side of the working oil supply system (150). Thereby, the pistons (6, 6, . . . ) supplied with high-pressure working oil are reduced to half the count in the low-speed mode. As a result, the motor capacity of the cam motor apparatus is reduced in half so that the motor apparatus is rotated in the high-speed mode having approximately double the speed and half the output torque in the low-speed mode.

At the time, the pressures in the cylinders (5) connected to the delivery side of the charging pump (16) are held at the same pressure as in the oil discharge side of the working oil supply system (150) through the supply of pressurized oil from the charging pump (16). Thereby, slide contact between the piston (6) in each of the cylinders (5) and the cam surface (3*a*) can be held without producing large rotational resistance. As a result, collision between the piston (6) and the cam surface (3*a*) can be prevented. This increases silentness and durability. Further, since there is no need for providing a spring for pressing the pistons (6, 6, . . . ) against the cam surface (3*a*), the component count of the apparatus can be decreased as compared with the prior art. This reduces the weight of the entire apparatus and increases ease of assembly.

As shown in FIG. 1, the cam motor apparatus described above can be configured such that the cam ring (3) is fixed in a non-rotating state to a body (13) of the cam motor apparatus and the cylinder block (2) is rotatably supported to the body (13).

According to this configuration, when the cylinder block (2) is rotated relative to the cam ring (3) fixed in a non-rotating state to the body (13) of the cam motor apparatus, the cam motor apparatus can supply a rotational driving force with reliability.

Further, under the above configuration, as shown in FIGS. 1, 4 and 5, the selector valve (9) can be configured to be changeable between the low rotational speed position and the high rotational speed position by pressurized oil supplied from the charging pump (16).

According to this configuration, the selector valve (9) operates through the supply of pressurized oil from the charging pump (16) for supplying charging oil to the oil discharge side of the working oil supply system (150). Accordingly, there is no need for providing any special driving source for operating the selector valve (9). This achieves cost reduction and compaction of the entire apparatus.

Furthermore, under the above configuration, as shown in FIGS. 4 and 5, the selector valve (9) can include a valve element (92) formed in a column and a charge pressure supply passage (926) formed in the valve element (92) and communicated through one end thereof with the charging pump (16), and can be configured such that the other end of the charge pressure supply passage (926) is open to the two communication passages (8*d*, 8*b*) connected to neither the oil supply side nor the oil discharge side of the working oil supply system (150) when the selector valve (9) is in the high rotational speed position.

According to this configuration, charging oil from the charging pump (16) is supplied to the two communication passages (8*d*, 8*b*) connected to neither the oil supply side nor the oil discharge side of the working oil supply system (150), through the charge pressure supply passage (926) formed in the valve element (92) of the selector valve (9). Thus, since the charge pressure supply passage (926) is formed in the valve element (92) of the selector valve (9), an oil pressure circuit for supplying charge pressure can be compacted. This compacts the entire apparatus.

Further, under the above configuration, as shown in FIG. 1, the working oil supply system (150) can be configured such that the oil supply side and the oil discharge side are reversible.

According to this configuration, by reversing the oil supply side and the oil discharge side of the working oil supply system (150) each other, the cam motor apparatus can be changed between a normal rotation and a reverse rotation. In the case of the reverse rotation as well as the case of the normal rotation, when the selector valve (9) is in the low rotational speed position, the cam motor apparatus obtains a maximum motor capacity so as to be rotated in the low-speed mode having relatively low speed and high output torque. On the other hand, when the selector valve (9) is in the high rotational speed position, the motor capacity of the cam motor apparatus is reduced in half so that the cam motor apparatus is rotated in the high-speed mode having approximately double the speed and half the output torque in the low-speed mode.

At the time, when the selector valve (9) is in the high rotational speed position, as in the case of the normal rotation, the two passages (8*d*, 8*b*) connected to neither the oil supply side nor the oil discharge side of the working oil supply system (150) are connected to the delivery side of the charging pump (16). Thereby, the pressures in the cylinders (5), supplied with pressurized oil from the charging pump (16) through the two passages (8*d*, 8*b*), are held at the same pressure as in the oil discharge side of the working oil supply system (150). Accordingly, slide contact between the piston (6) in each of the cylinders (5) and the cam surface (3*a*) can be held without producing large rotational resistance. As a result, also in the reverse rotation, silentness and durability in the high-speed mode can be increased.

BEST MODE FOR CARRYING OUT THE INVENTION

Embodiments for carrying out the invention will be described with reference to the drawings.

Figure 1:
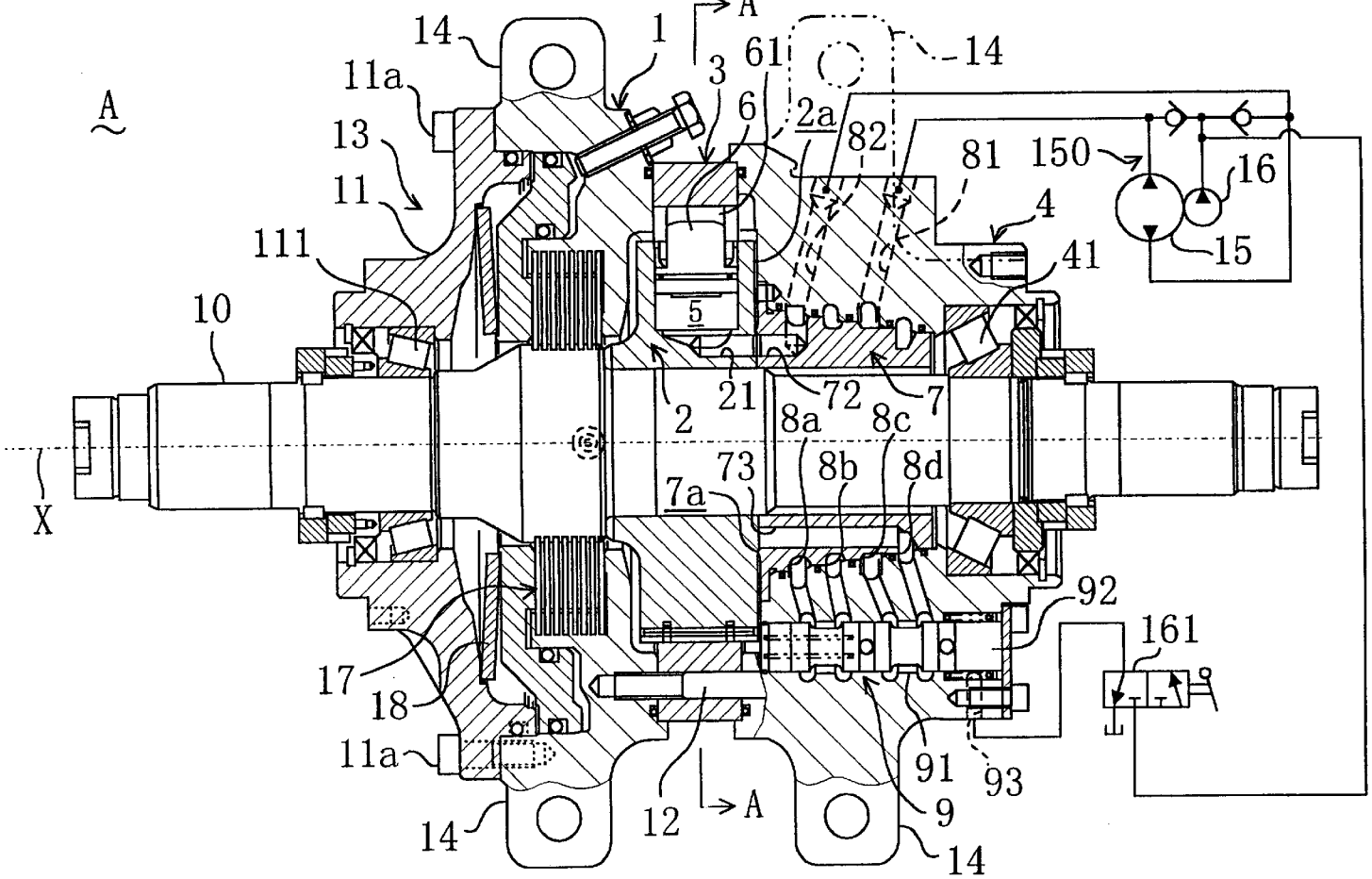
FIG. 1 is a partly cutaway view of an embodiment of the present invention.

FIG. 1 shows a cam motor apparatus A according to an embodiment of the present invention. In FIG. 1, a reference numeral 1 denotes an annularly shaped casing body, a reference numeral 2 denotes a cylinder block formed in a cylinder having a heavy wall thickness, a reference numeral 3 denotes a cam ring disposed so as to surround the outer periphery of the cylinder block (2), and a reference numeral 4 denotes an end cap. Reference numerals 5, 5, . . . (See FIG. 2) denote a plurality of cylinders disposed in the cylinder block (2), a reference numeral 6 denotes a piston housed in each of the cylinders (5), and a reference numeral 7 denotes a distribution valve for distributing working oil to the cylinders (5, 5, . . . ). Reference numerals 8*a*, 8*b*, 8*c*, 8*d* denote annular communication passages as four communication passages formed so as to surround the outer periphery of the distribution valve (7), a reference numeral 9 denotes a supply/discharge operating valve as a selector valve for selectively connecting the annular communication passages (8*a*, 8*b*, 8*c*, 8*d*) to an oil supply side or an oil discharge side for working oil, and a reference numeral 10 denotes an output shaft. The cam motor apparatus A is provided in a construction machine or the like for driving wheels, crawlers or the like.

The casing body (1) is disposed coaxially with the output shaft (10) and is connected to an approximately conical casing cover (11) disposed at a part of the output shaft (10) located at one side along the length of the output shaft (10) (a left side of FIG. 1: hereinafter, referred to as a left side), through a plurality of bolts (11*a*, 11*a*, . . . ). Further, the casing body (1) is connected at the other side of the output shaft (10) (a right side of FIG. 1: hereinafter, referred to as a right side) to the cam ring (3) and the end cap (4) through a plurality of bolts (12, 12, . . . ) (See FIG. 2). In this manner, a casing (13) forming a main body of the cam motor apparatus A is formed. The output shaft (10) passes through the casing (13) in a lateral direction of FIG. 1 and is rotatably supported to the casing (13) through tapered roller bearings (111, 41) respectively disposed in the casing cover (11) and the end cap (4). In the outer peripheries of the casing body (1) and the end cap (4), mounting flanges (14, 14, . . . ) protruding outward are provided. The casing (13) is fixed to a vehicle body through the mounting flanges (14, 14, . . . ).

Figure 2:
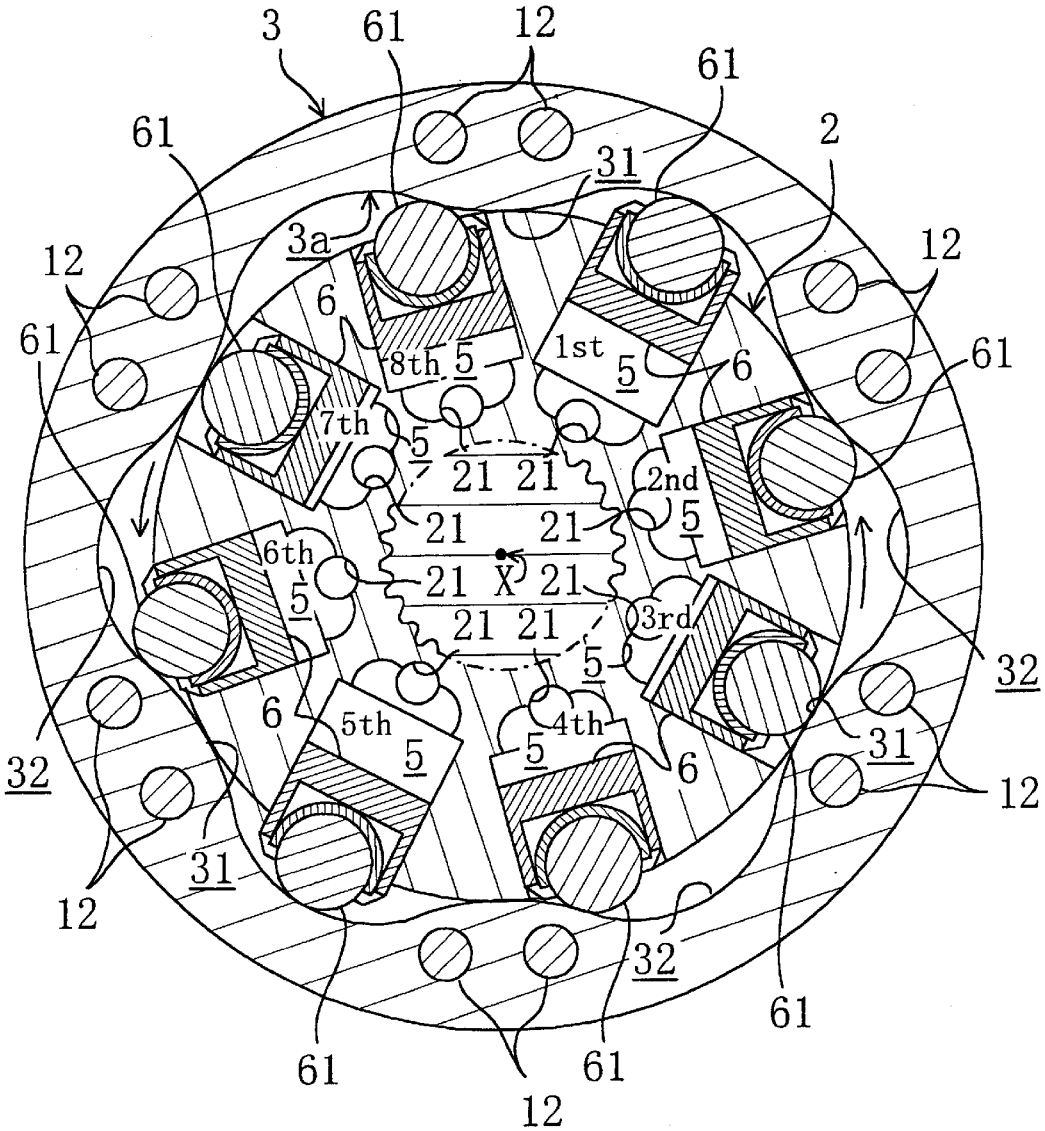
FIG. 2 is a cross-sectional view taken on line A—A of FIG. 1.

The cylinder block (2) is coupled to the outer periphery of the output shaft (10), for example, by spline coupling, and is disposed so as to rotate on a rotational axis (X) (i.e., a central axis of the cylinder block (2) together with the output shaft (10). In the cylinder block (2), as shown in FIG. 2, a plurality (eight in the figure) of cylinders (5, 5, . . . ) are radially formed around the rotational axis (X) at uniform intervals in a circumferential direction, extend outward in a radial direction of the cylinder block (2) and are open in the outer periphery of the cylinder block (2). Each of the cylinders (5) houses a piston (6). Each of the pistons (6) rotates a roller (61) formed at an end thereof, along a cam surface (3*a*) formed in the inner periphery of the cam ring (3), and concurrently extends and retracts in the cylinder (5) in a manner to be guided by the cam surface (3*a*). Further, in the cylinder block (2), eight distributed-side ports (21, 21, . . . ) are formed so as to be communicated with the respective cylinders (5, 5, . . . ) and to be open in the end surface (2*a*) (i.e., a right-end surface in the figure) of the cylinder block (2) at uniform intervals on a circumference around the rotational axis (X).

As shown in FIG. 2, the cam ring (3) is provided at the cam surface (3*a*) with a specified count (six in the figure) of convex parts (31, 31, . . . ) and a specified count (six in the figure) of concave parts (32, 32, . . . ), which are alternately formed at uniform intervals in a circumferential direction and whose counts are determined based on the piston count and arrangement. As for the positional relationships of the eight pistons (6, 6, . . . ) to the cam surface (3*a*), when the piston (6) located at the upper right of FIG. 2 is termed a first piston and other pistons are sequentially termed second to eighth pistons in a clockwise direction, these pistons are positioned such that the first and fifth pistons (6, 6) each come into contact with approximately the bottom point of the concave part (32), the second and sixth pistons (6, 6) each come into contact with approximately a middle point between the concave part (32) and the convex part (31) (i.e., each enter the descending cycle), the third and seventh pistons (6, 6) each come into contact with approximately the top point of the convex part (31) and the fourth and eighth pistons (6, 6) each come into contact with approximately a middle point between the convex part (31) and the concave part (32) (i.e., each enter the ascending cycle).

Under the above positional relationships, when working oil is mainly supplied to the fourth and eight pistons (6, 6) such that they press the cam surface (3*a*), the cylinder block (2) rotates in a counterclockwise direction of FIG. 2 (a direction shown in arrows) around the central axis (X). Subsequently, when working oil is mainly supplied to the third and seventh pistons (6, 6), the cylinder block (2) further rotates. This rotation causes the second and sixth pistons (6, 6) to overcome the convex part (31) and working oil is then supplied to the second and sixth pistons (6, 6). In this manner, working oil is distributively supplied to the pistons (6, 6, . . . ) so that the cylinder block (2) and the output shaft (10) are successively driven into rotation in one piece.

The distribution valve (7) is formed in approximately a column, is disposed such that one end surface (7*a*) thereof (a left-end surface: hereinafter, referred to as a coupled end surface) is relatively rotatably coupled to the right-end surface (2*a*) of the cylinder block (2), and is fixed in a non-rotating state in a manner to be fitted in the end cap (4). In the inner periphery of the end cap (4), four annular concave parts, arranged in a longitudinal direction of the output shaft (10) (a lateral direction of FIG. 1), are formed over the circumference and are open so as to correspond to the shape of the outer periphery of the distribution valve (7).

Figure 3:
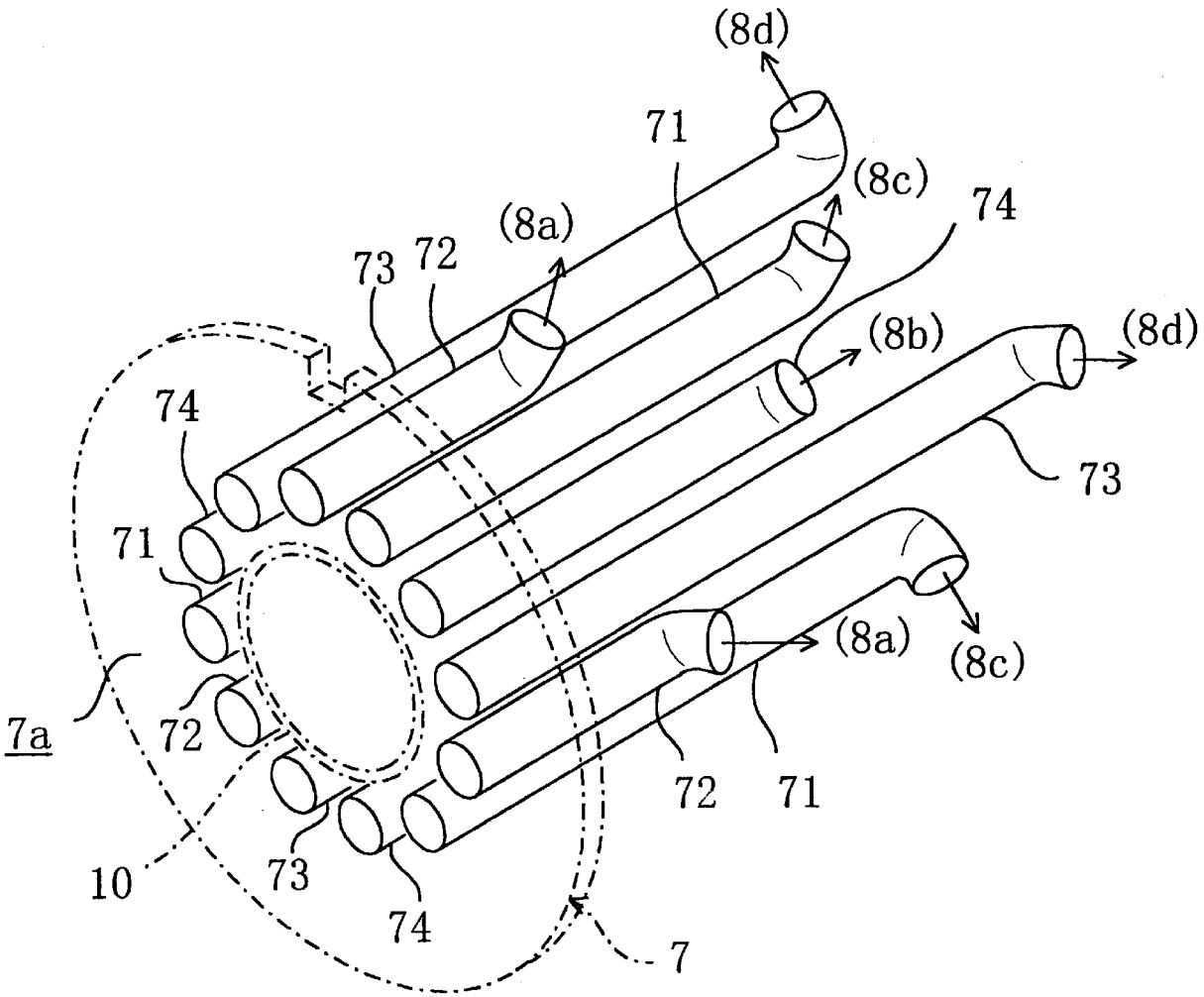
FIG. 3 is a perspective view showing the arrangement of distribution ports.

The annular concave parts and the outer periphery of the distribution valve (7) define second, fourth, first and third annular communication passages (8*a*, 8*b*, 8*c*, 8*d*) in the order from the left end. In the coupled end surface (7*a*), as shown in FIG. 3, distribution ports (71, . . . , 72, . . . , 73, . . . , 74, . . . ), whose count is an integral multiple (12 in the figure) of the count of the convex parts (31, . . . ) or the count of the concave parts (32, . . . ) of the cam surface (3*a*), are provided so as to be communicable with the distributed-side ports (21, 21, . . . ) disposed in the right-end surface (2*a*) of the cylinder block (2) and so as to be open at uniform intervals on the same circumference where the distributed-side ports (21, 21, . . . ) are located.

The distribution ports (71, . . . , 72, . . . , 73, . . . , 74, . . . ) are divided into a first distribution port group composed of first distribution ports (71, 71, . . . ) arranged every three ports in a circumferential direction, a second distribution port group composed of second distribution ports (72, 72, . . . ) each disposed next to the first distribution port in a direction of normal rotation of the cylinder block (2) (in a counterclockwise direction of FIG. 3), a third distribution port group composed of third distribution ports (73, 73, . . . ) each disposed next to the second distribution port in the same direction, and a fourth distribution port group composed of fourth distribution ports (74, 74, . . . ) each disposed next to the third distribution port in the same direction. An end (a right end in FIG. 3) of each of the first distribution ports (71) located far from the cylinder block (2) extends to the first annular communication passage (8*c*) in the longitudinal direction of the output shaft (10) so as to be communicated with the first annular communication passage (8*c*). Similarly, the second distribution ports (72, 72, . . . ) are individually communicated with the second annular communication passage (8*a*), the third distribution ports (73, 73, . . . ) are individually communicated with the third annular communication passage (8*d*), and the fourth distribution ports (74, 74, . . . ) are individually communicated with the fourth annular communication passage (8*b*).

Among the four annular communication passages (8*c*, 8*b*, . . . ), the first annular communication passage (8*c*) is connected to a main pump (15) through a supply passage (81), and receives working oil discharged from the main pump (15) when the cam motor apparatus (A) is normally rotated. On the other hand, the second annular communication passage (8*a*) is connected to the main pump (15) through a discharge passage (82), and returns working oil, discharged from the cylinder block (2), to the main pump (15) when the cam motor apparatus (A) is normally operated. A working oil supply system (150) is formed of: a closed circuit composed of the main pump (15), the supply passage (81), the discharge passage (82) and so on; and a charging pump (16) for adding charging oil to the passage that is put under low pressure so as to cope with leakage of working oil from the closed circuit. The main pump (15) is configured so as to be reversible between a suction direction and a delivery direction of working oil. Under this configuration, when the oil supply side and the oil discharge side of the working oil supply system (150) are reversed each other so that working oil is supplied to the discharge passage (82), the output shaft (10) is reversely rotated. As a result, the cam motor apparatus (A) can be reversely rotated.

Figure 4:
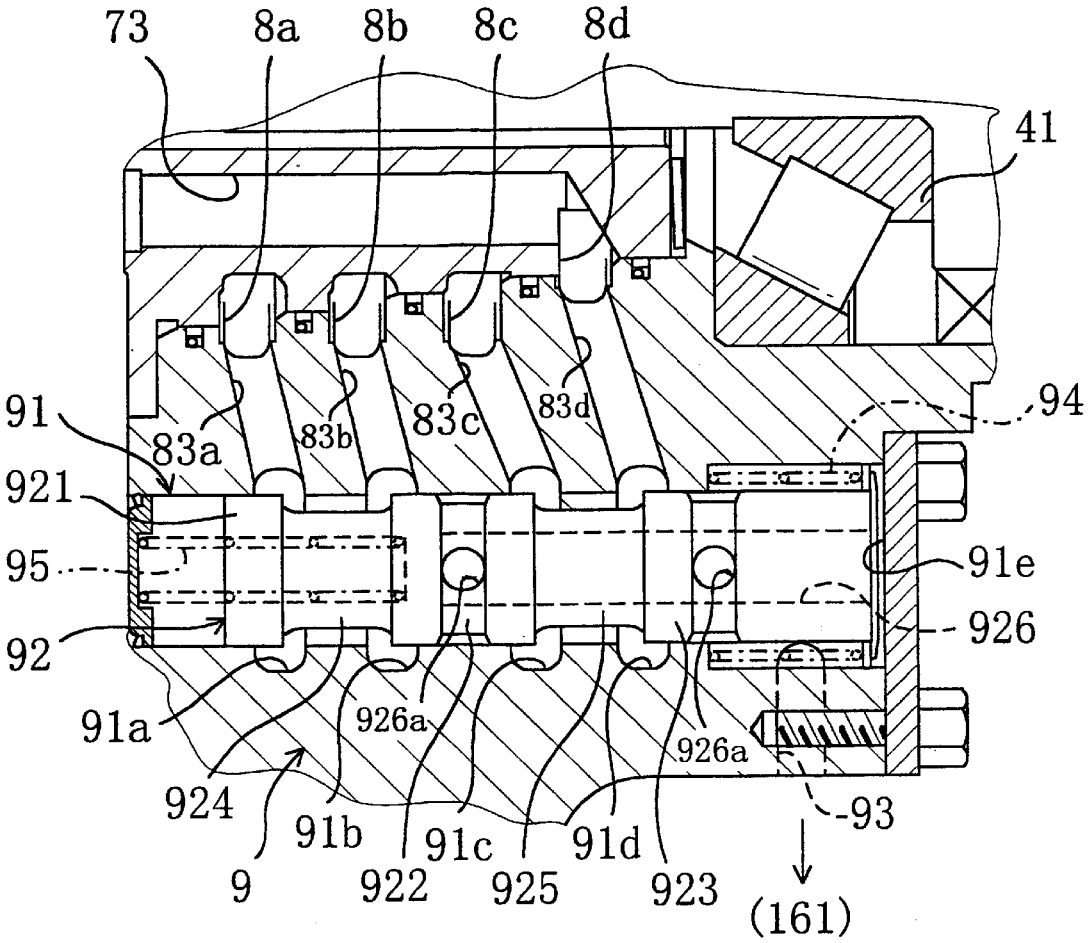
FIG. 4 is an enlarged sectional view showing the structure of a supply/discharge operating valve.
Figure 5:
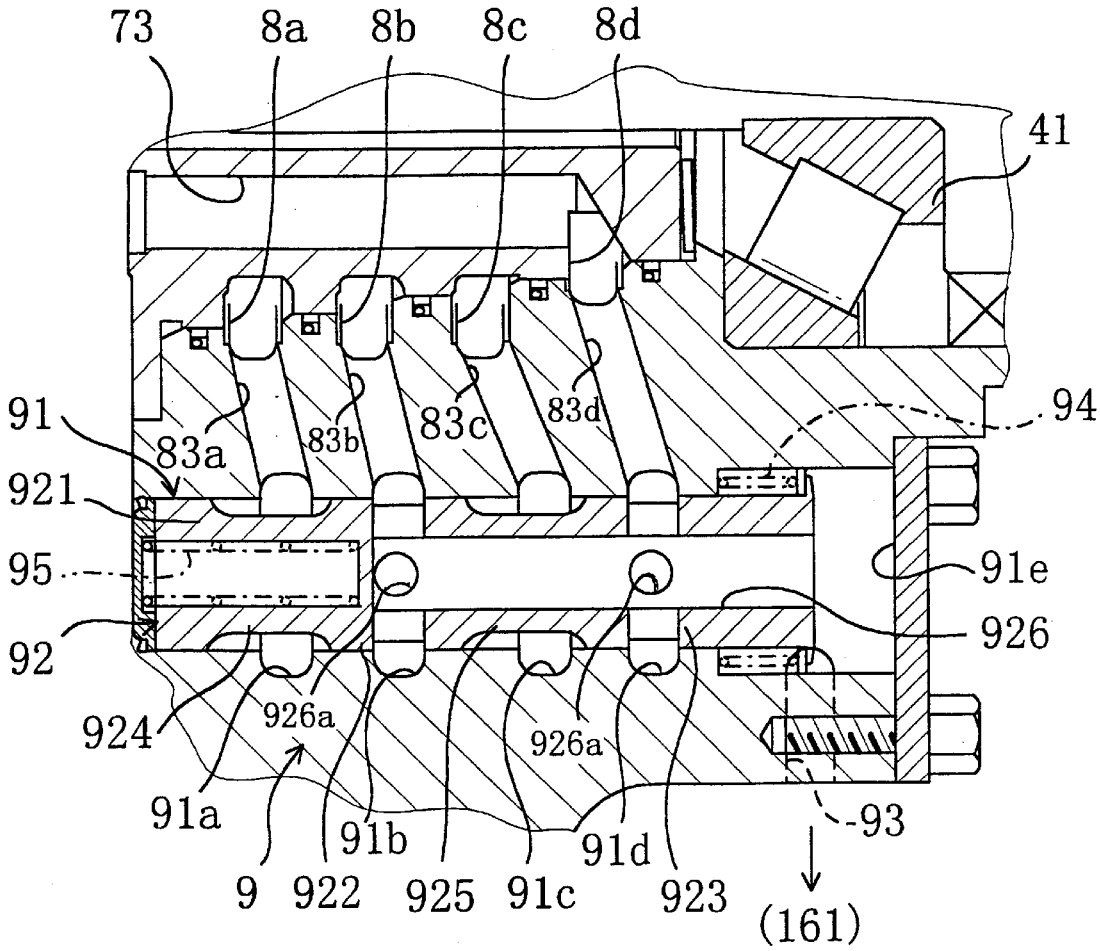
FIG. 5 is a diagram of the supply/discharge operating valve in a high rotational speed position, which corresponds to FIG. 4.

The supply/discharge operating valve (9) is composed of a valve room (91) formed in the end cap (4) so as to have a circular form in cross section and a cylindrical valve element (92) housed in the valve room (91) so as to be slidable in a longitudinal direction (a lateral direction). As shown in FIGS. 4 and 5 in detail, the valve room (91) includes first, second, third and fourth enlarged-diameter parts (91*a*, 91*b*, 91*c*, 91*d*) in the order from the left side of the figures (hereinafter, referred to as the left side). These four enlarged-diameter parts (91*a*, 91*b*, 91*c*, 91*d*) are individually communicated with the four annular communicationpassages (8*a*, 8*b*, 8*c*, 8*d*) through four communication passages (83*a*, 83*b*, 83*c*, 83*d*) formed in the end cap (84).

At the right end of the valve room (91) in FIGS. 4 and 5 (hereinafter, referred to as the right end), a cylinder part (91*e*) is formed. When a selector valve (161) (See FIG. 1) is in its right position, the cylinder part (91*e*) receives pressurized oil from the charging pump (16) through a charging oil supply passage (93) to operate the valve element (92). The valve element (92) comprises first, second and third large-diameter parts (921, 922, 923) in the order from the left side, small-diameter parts (924, 925) intermediately formed among the large-diameter parts (921, 922, 923), and a charge pressure supply passage (926) which is open at one end thereof on the right end surface of the valve element (92) and passes through the valve element (92) along the length of the valve element (92) (in a lateral direction of the figure) such that the other end extends to the second large-diameter part (922). The charge pressure supply passage (926) has four openings (926*a*, 926*a*, . . . ) formed in the outer periphery of the second large-diameter part (922) at uniform intervals in a circumferential direction and four openings (926*a*, 926*a*, . . . ) formed in the outer periphery of the third large-diameter part (923) at uniform intervals in a circumferential direction.

As shown in FIG. 4, the valve element (92) is urged rightward by resilient forces of springs (94, 95) so as to be positioned in a low rotational speed position. In this low rotational speed position, the valve element (92) communicates the third enlarged-diameter part (91*c*) with the fourth enlarged-diameter part (91*d*) and concurrently communicates the first enlarged-diameter part (91*a*) with the second enlarged-diameter part (91*b*). Accordingly, when the valve element (92) is in the low rotational speed position, the first and third annular communication passages (8*c*, 8*d*) are communicated with the supply passage (81) and concurrently the second and fourth annular communication passages (8*a*, 8*b*) are communicated with the discharge passage (82).

On the other hand, when the cylinder part (91*e*) is supplied with charge pressure, the charge pressure causes the valve element (92) to move leftward against the resilient forces of the springs (94, 95) so that the valve element (9) is changed into a high rotational speed position as shown in FIG. 5. As a result, the second enlarged-diameter part (91*b*) is communicated with the fourth enlarged-diameter part (91*d*) through the charge pressure supply passage (926). At the time, the charge pressure is transmitted from the cylinder part (91*e*) to the second and fourth enlarged-diameter parts (91*b*, 91*d*) through the charge pressure supply passage (926), whereas the first and third enlarged-diameter parts (91*a*, 91*c*) are each put into a state that communication with other enlarged-diameter parts is interrupted. In other words, the first annular communication passage (8*c*) is communicated with the supply passage (81), the second annular communication passage (8*a*) is communicated with the discharge passage (82), and the third and fourth annular communication passages (8*d*, 8*b*) are communicated with each other and are supplied with charge pressure.

Accordingly, when the valve element (92) of the supply/discharge operating valve (9) is in the low rotational speed position (See FIG. 4), working oil having passed through the supply passage (81) is supplied to each of the first and third distribution ports (71, 73), whose total number is 6, through the third and fourth enlarged-diameter parts (91*c*, 91*d*) and the first and third annular communication passages (8*c*, 8*d*), so that the distribution ports (71, 73) are put under high pressure. Concurrently, the second and fourth distribution ports (72, 74), whose total number is 6, are communicated with the discharge passage (82) through the second and fourth annular communication passages (8*a*, 8*b*) and the first and second enlarged-diameter parts (91*a*, 91*b*) and thereby are put under low pressure. In short, six among the twelve distribution ports (71, . . . , 72, . . . , 73, . . . , 74, . . . ) are under high pressure and the remaining six are under low pressure.

On the other hand, when the valve element (92) of the supply/discharge operating valve (9) is in the high rotational speed position (See FIG. 5), working oil having passed through the supply passage (81) is supplied to the three first distribution ports (71) through the third enlarged-diameter part (91*c*) and the first annular communication passage (8*c*) so that the first distribution ports (71) are put under high pressure. Concurrently, the three second distribution ports (72) are communicated with the discharge passage (82) through the second annular communication passage (8*a*) and the first enlarged-diameter part (91*a*) and thereby are put under low pressure, and the three third distribution ports (73) are communicated with the three fourth distribution ports (74) through the third and fourth annular communication passages (8*d*, 8*b*) and the second and fourth enlarged-diameter parts (91*b*, 91*d*) and are held under charge pressure. In short, three among the twelve distribution ports (71, . . . , 72, . . . , 73, . . . , 74, . . . ) are under high pressure, another three distribution ports are under low pressure and the remaining six distribution ports are supplied with charge pressure.

In FIG. 1, a reference numeral 17 denotes a negative brake mechanism for blocking rotation of the output shaft (10). The negative brake mechanism (17) has a plurality of pressure rings affixed on the outer periphery of the output shaft (10) and pressure plates each interposed between the adjacent pressure rings and affixed on the inner periphery of the casing body (1). When supplied with no pressurized oil from the charging pump (16), the negative brake mechanism (17) makes the pressure rings and the pressure plates pressed against each other by a pressing force urged by a belleville spring (18) to cause a frictional force due to slide therebetween, and the frictional force blocks rotation of the output shaft (10) relative to the casing body (1). On the other hand, when the negative brake mechanism (17) is supplied with pressurized oil from the charging pump (16), the pressure rings are separated from the pressure plates so that the output shaft (10) is released from the brakes to become freely rotatable.

Description will be made below about operations and effects of the cam motor apparatus A of this embodiment.

First, the charging pump (16) is activated so that the negative brake mechanism (17) is supplied with pressurized oil. Thereby, the output shaft (10) is released from the brakes applied by the negative brake mechanism (17). Subsequently, the main pump (15) is activated so that the supply passage (81) is supplied with working oil.

At this point, in the case where the cam motor apparatus A is rotated in a low-speed mode, the selector valve (161) is changed into its left position to block the supply of pressurized oil from the charging pump (16) to the supply/discharge operating valve (9). As a result, the valve element (92) of the supply/discharge operating valve (9) is positioned in the low rotational speed position (See FIG. 4) so that the first and third distribution ports (71, 73), whose total number is 6, are changed into ports for supplying working oil while the second and fourth distribution ports (72, 74), whose total number is 6, are changed into ports for discharging working oil. Thereby, working oil is supplied to a half of the eight cylinders (5, 5, . . . ), i.e., four cylinders (5, 5, . . . ) in the ascending cycle (i.e., the third, fourth, seventh and eighth cylinders of FIG. 2), so that the pistons (6, 6, . . . ) housed in these cylinders (5, 5, . . . ) each generate a driving force, which causes the cylinder block (2) and the output shaft (10) to rotate together. This rotation provides a change in positional relationship between the cylinder block (2) and the distribution valve (7). As a result, working oil is supplied to another four cylinders (5, 5, . . . ) that subsequently enter the ascending cycle (i.e., the second, third, sixth and seventh cylinders in FIG. 2) so that the cylinder block (2) further rotates. Such an operation is repeated so that the cylinder block (2) and the output shaft (10) successively rotate. On the other hand, working oil is discharged from four cylinders (5, 5, . . . ) in the descending cycle by their pistons (6, 6, . . . ) and is returned to the suction side of the main pump (15) through the discharge passage (82). In this manner, the cam motor apparatus A in the low-speed mode is rotated with a maximum motor capacity at relatively low speed and relatively high output torque.

In the case where the cam motor apparatus A is rotated in a high-speed mode, the selector valve (161) is changed into its right position to allow the supply of pressurized oil from the charging pump (16) to the supply/discharge operating valve (9). As a result, the valve element (92) of the supply/discharge operating valve (9) is positioned in the high rotational speed position (See FIG. 5), so that the three first distribution ports (71) are changed into ports for supplying working oil, the three second distribution ports (72) are changed into ports for discharging working oil, and the third and fourth distribution ports (73, 74), whose total number is 6, are communicated with each other and are supplied with charge pressure. Thereby, working oil is supplied to a quarter of the eight cylinders (5, 5, . . . ), i.e., a half of four cylinders (5, 5, . . . ) in the ascending cycle (the fourth and seventh cylinders in FIG. 2), so that the pistons (6, 6) housed in the two cylinders (5, 5) each generate a driving force. On the other hand, working oil is discharged from a half of four cylinders (5, 5, . . . ) in the descending cycle (i.e., the first and sixth cylinders in FIG. 2). Further, in each of the remaining four cylinders (5, 5, . . . ) (i.e., the second, third, fifth and eighth cylinders in FIG. 2), the piston (6) reciprocates in the cylinder (5) along the cam surface (3*a*) but generates no driving force. In this manner, the cam motor apparatus A in the high-speed mode is rotated with approximately half the motor capacity in the low-speed mode at relatively high speed and relatively low output torque.

In the high-speed mode, charge pressure is supplied to the cylinders (5) connected to neither the ports for supplying working oil nor the ports for discharging working oil, so that the pistons (6) are held in slide contact with the cam surface (3*a*). This prevents collision between the pistons (6) and the cam surface (3*a*), thereby providing increase in silentness and durability. Further, since there is no need for providing a spring for pressing the pistons (6) against the cam surface (3*a*), the component count of the cam motor apparatus A can be decreased as compared with the conventional case. This reduces the weight of the entire apparatus and increases ease of assembly.

Furthermore, in the cam motor apparatus A of this embodiment, the third distribution ports (73, 73, . . . ) and the fourth distribution ports (74, 74, . . . ) are connected in the high-speed mode, and the charge pressure supply passage (926) for supplying charge pressure to the third and fourth distribution ports (73, . . . , 74, . . . ) is formed in the valve element (92) of the selector valve (9). This compacts the oil pressure circuit for supplying charge pressure, which compacts the entire apparatus.

In the case where the cam motor apparatus A is reversely rotated, the main pump (15) is reversely operated between its suction direction and its delivery direction so that the oil supply side and the oil discharge side of the working oil supply system (150) are reversed each other, which allows working oil to be supplied to the discharge passage (82). When the cam motor apparatus A is reversely rotated in the low-speed mode, the supply/discharge operating valve (9) is positioned into the low rotational speed position as in the case of the normal rotation in the low-speed mode, so that the second and fourth distribution ports (72, 74), whose total number is 6, are changed into ports for supplying working oil while the first and third distribution ports (71, 73), whose total number is 6, are changed into ports for discharging working oil. Thereby, working oil is supplied to the four cylinders (5, 5, . . . ) in the ascending cycle while working oil is discharged from the four cylinders (5) in the descending cycle. As a result, the cam motor apparatus A can be rotated at relatively low speed and relatively high output torque.

On the other hand, when the cam motor apparatus A is reversely rotated in the high-speed mode, the supply/discharge operating valve (9) is changed into the high rotational speed position as in the case of the normal rotation in the high-speed mode, so that the three second distribution ports (72) are changed into ports for supplying working oil, the three first distribution ports (71) are changed into ports for discharging working oil, and the third and fourth distribution ports (73, 74), whose total number is 6, are communicated with each other and are supplied with charge pressure. Thereby, working oil is supplied to a half of the four cylinders (5, 5, . . . ) in the ascending cycle while working oil is discharged from a half of the four cylinders (5, 5, . . . ) in the descending cycle. As a result, the cam motor apparatus A can be rotated at relatively high speed and relatively low output torque.

Figure 6:
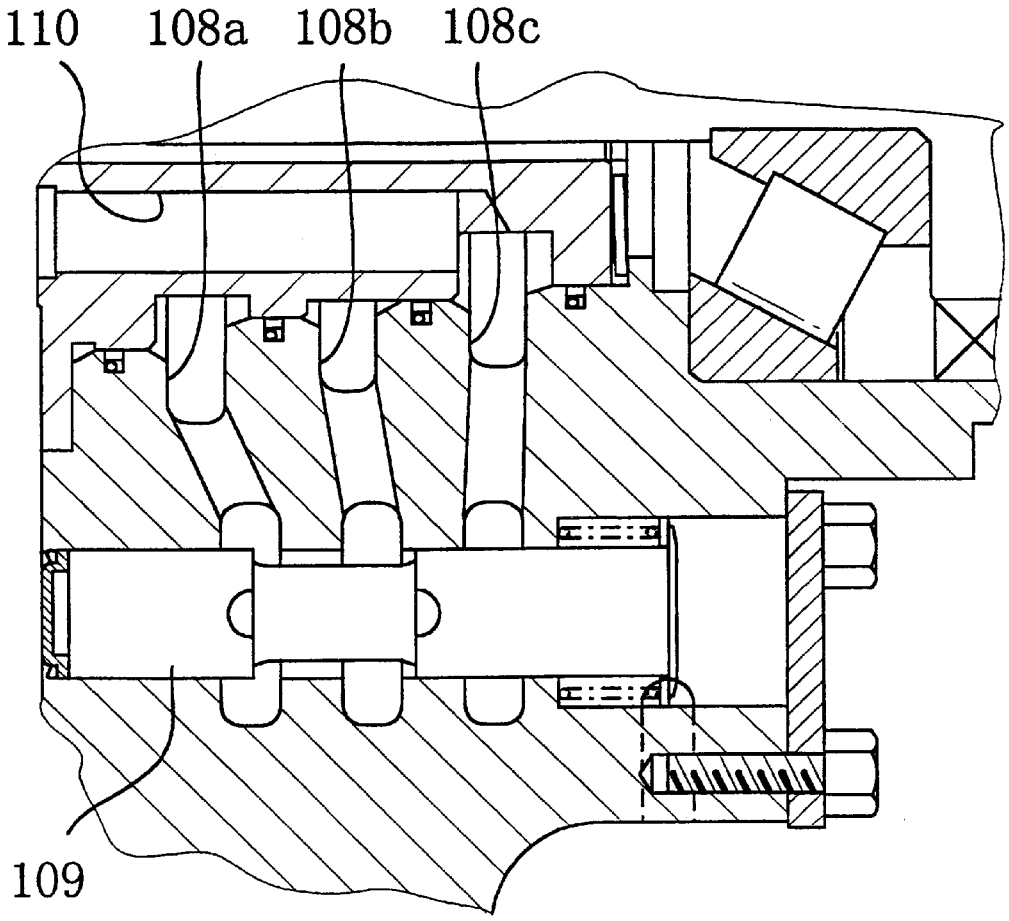
FIG. 6 is a diagram showing an exemplified structure of a supply/discharge operating valve in a conventional cam motor apparatus.

Comparison will be made below between the cam motor apparatus in reverse rotation of this embodiment and the conventional cam motor apparatus illustrated in FIG. 6. The conventional cam motor apparatus is configured such that a plurality of pistons and cylinders are divided into three piston-cylinder groups and working oil is distributed among the three piston-cylinder groups through three communication passages (108*a*, 108*b*, 108*c*), respectively. Specifically, twelve distribution ports are divided into a group of six first distribution ports (not shown), a group of three second distribution ports (not shown) and a group of three third distribution ports (110) (only one port is shown in the figure). The first communication passage (108*a*) located on the left side of the figure (hereinafter, referred to as the left side) is communicated with the first distribution ports, the second communication passage (108*b*) located in the middle position is communicated with the second distribution ports, and the third communication passage (108*c*) located on the right side of the figure (hereinafter, referred to as the right side) is communicated with the third distribution ports. Further, the first communication passage (108*a*) is communicated with a discharge passage for working oil and the third communication passage (108*c*) is communicated with a supply passage for working oil.

When the conventional cam motor apparatus is normally rotated in the high-speed mode, the three third distribution ports (110) are supplied with working oil through the third communication passage (108*c*) so as to be put under high pressure, whereas the six first distribution ports and the three second distribution ports are put under low pressure through the first communication passage (108*a*) and the second communication passage (108*b*), which are communicated with each other by a selection of a supply/discharge operating valve (109).

When the conventional cam motor apparatus is reversely rotated in the high-speed mode, in contrast to the case of the above-described normal rotation, the first communication passage (108*a*) and the second communication passage (108*b*) are supplied with high-pressure working oil through the discharge passage, so that the six first distribution ports and the three second distribution ports are put under high pressure, whereas the third communication passage (108*c*) is communicated with the supply passage so that the three third distribution ports (110) are put under low pressure. In this manner, in the conventional cam motor apparatus, high-pressure working oil is supplied not only to the cylinders generating driving forces for reverse rotation but also to the cylinders generating no driving force. This extremely increases rotational resistance and increases ill thermal effect.

On the other hand, when the cam motor apparatus A of this embodiment is reversely rotated in the high-speed mode, high-pressure working oil is supplied to the second annular communication passage (8*a*) (See FIG. 5) through the discharge passage (82), and the first annular communication passage (8*c*) is communicated with the supply passage (81) so that working oil is discharged. Further, as is the case with the normal rotation in the high-speed mode, the third and fourth annular communication passages (8*d*, 8*b*) are supplied with charge pressure having the same pressure as in the discharge side of the working oil supply system (150) and the charge pressure can hold slide contact between the piston (6) and the cam surface (3*a*) without producing large rotational resistance. This largely decreases rotational resistance with the operation of the piston (6) as compared with the conventional case as shown in FIG. 6, minimizes ill thermal effect and provides increase in silentness and durability also during reverse rotation in the high-speed mode.

The present invention is not limited to the above embodiment and can include various kinds of other embodiments. For example, though the cam motor apparatus A of the above embodiment has a configuration that the cam ring (3) is affixed to the casing (13) and the output shaft (10) is connected to the cylinder block (2) rotating relative to the cam ring (3), the cam motor apparatus of the present invention can have a configuration that the cylinder block is affixed to the main body of the apparatus and an annular casing with a cam ring is rotated relative to the cylinder block.

Further, though the cam motor apparatus of the above embodiment has a configuration that six convex parts (31, 31, . . . ) and six concave parts (32, 32, . . . ) are formed in the cam surface (3*a*) of the cam ring (3) and eight pistons (6, 6, . . . ) are correspondingly disposed in the cylinder block (2), another embodiment of the present invention can have a configuration that both a convex part count and a concave part count are same values other than 6 and pistons whose count is a value except 8 are correspondingly disposed.

INDUSTRIAL APPLICABILITY

According to the present invention, in a cam motor apparatus selectable between two stages of high and low rotational speeds, noise reduction and increased durability can be achieved in the high rotational speed mode, and the component count of the apparatus can be reduced, resulting in weight reduction and cost reduction. This contributes to widespread use of the cam motor apparatus. Accordingly, the present invention has a high industrial applicability.

What is claimed is:

1. A cam motor apparatus comprising:

a cylindrical cylinder block (2);

a cam ring (3) having a cam surface (3*a*) formed in the inner periphery thereof and disposed surrounding the outer periphery of the cylinder block (2);

a plurality of cylinders (5, 5, . . . ) radially formed in the cylinder block (2) to extend radially outward around the central axis (X) of the cylinder block (2) and to be open in the outer periphery of the cylinder block (2);

pistons (6) respectively housed in the cylinders (5) in a manner to extend to and retract from the cam surface (3*a*); and a distribution valve (7), coupled to an end surface (2*a*) of the cylinder block (2) in a manner to be rotatable relative to the cylinder block (2), for distributing working oil, supplied from a working oil supply system (150), to the cylinders (5) corresponding to the pistons (6) in an ascending cycle of ascending toward the cam surface (3*a*) out of the plurality of cylinders (5, 5, . . . ), wherein the pistons (6) in the ascending cycle press the cam surface (3*a*) so that one of the cylinder block (2) and the cam ring (3) the other of which is fixed in a non-rotating state rotates relative to the other, the cam motor apparatus further comprises:

four communication passages (8*a*, 8*b*, 8*c*, 8*d*) for supplying working oil to the plurality of cylinders (5, 5, . . . ) divided into four groups in a manner to distribute the working oil among the four groups; and a selector valve (9) for selectively connecting the four communication passages (8*a*, 8*b*, 8*c*, 8*d*) to an oil supply side or an oil discharge side of the working oil supply system (150) to change the rotation of the cylinder block (2) or the cam ring (3) between a low-speed mode and a high-speed mode, the cylinder block (2) is provided with distributed-side ports (21, 21, . . . ) which are communicated with the respective cylinders (5, 5, . . . ) and are open at the end surface (2*a*) at uniform intervals on a circumference around the central axis (X), the distribution valve (7) is provided at an end surface (71, . . . , 72, . . . , 73, . . . , 74, . . . ) a count of which is an integral multiple of 4 and which are formed to be open at uniform intervals on the same circumference as the distributed-side ports (21, 21, . . . ) are located, the distribution ports (71, . . . , 72, . . . , 73, . . . , 74, . . . ) being divided into four distribution port groups having the same port count, the distribution ports being each communicated at an end thereof with one of the four communication passages (8*a*, 8*b*, 8*c*, 8*d*) in units of the distribution port groups, the selector valve (9) includes:

a low rotational speed position that connects two passages (8*c*, 8*d*or 8*a*, 8*b*), selected from among the four communication passages (8*a*, 8*b*, 8*c*, 8*d*), to the oil supply side of the working oil supply system (150) and connects the other two passages (8*a*, 8*b*or 8*c*, 8*d*) to the oil discharge side of the working oil supply system (150); and a high rotational speed position that connects one (8*c* or 8*a*) of the selected two passages to the oil supply side, connects one (8*a* or 8*c*) of the other two passages to the oil discharge side and connects the remaining two passages (6*d*, 8*b*) to a delivery side of a charging pump (16) for supplying charging oil to the oil discharge side of the working oil supply system (150).

2. The cam motor apparatus of claim 1, wherein the cam ring (3) is fixed in a non-rotating state to a body (13) of the cam motor apparatus and the cylinder block (2) is rotatably supported to the body (13).

3. The cam motor apparatus of claim 1, wherein the selector valve (9) is configured to be changeable between the low rotational speed position and the high rotational speed position by pressurized oil supplied from the charging pump (16).

4. The cam motor apparatus of claim 1 or 3, wherein the selector valve (9) includes a valve element (92) formed in a column and a charge pressure supply passage (926) formed in the valve element (92) and communicated through one end thereof with the charging pump (16), and the other end of the charge pressure supply passage (926) is open to the two communication passages (8*d*, 8*b*) connected to neither the oil supply side nor the oil discharge side of the working oil supply system (150) when the selector valve (9) is in the high rotational speed position.

5. The cam motor apparatus of claim 1, wherein the working oil supply system (150) is configured such that the oil supply side and the oil discharge side are reversible.

* * * * *

UNITED STATES PATENT AND TRADEMARK OFFICE

CERTIFICATE OF CORRECTION

PATENT NO. : 6,050,173

DATED : April 18, 2000

INVENTOR(S) : Toshiyuki SAKAI et al.

It is certified that an error appears in the above-identified Letters Patent and that said Letters Patent is hereby corrected as shown below:

Title page of the patent under [75] Inventors, please change the residence of the third inventor as follows:

[Masaaki Suhara, Oaaka, all of Japan] to --Masaaki Suhara, Osaka, all of Japan--.

Signed and Sealed this

Twentieth Day of March, 2001

*Attest:*

Nicholas P. Godici

NICHOLAS P. GODICI

*Attesting Officer*

*Acting Director of the United States Patent and Trademark Office*